US005897104A

United States Patent [19]

Garbiso

[11] Patent Number: 5,897,104

[45] **Date of Patent: *Apr. 27, 1999**

[54] OVERHEAD HOIST AND SLING APPARATUS FOR REMOVING, STORING AND REPLACING A REMOVABLE AUTOMOBILE HARDTOP

[76] Inventor: Michael J. Garbiso, 2107 Starfall, Chino Hills, Calif. 91710

[ * ] Notice: This patent issued on a continued prosecution application filed under 37 CFR 1.53(d), and is subject to the twenty year patent term provisions of 35 U.S.C. 154(a)(2).

[21] Appl. No.: 08/642,784

[22] Filed: May 3, 1996

[51] Int. Cl.[6] ..... B66D 1/00

[52] U.S. Cl. ..... 254/334; 248/327; 383/22; 383/67; 414/626

[58] Field of Search ..... 254/269, 334, 254/335, 336, 338, 343; 248/327, 323; 150/166, 168; 383/22, 97, 67; 296/136; 160/370.2; 414/626; 294/74

[56] References Cited

U.S. PATENT DOCUMENTS

| | | | |
|---|---|---|---|
| 1,259,942 | 3/1918 | Weaver | 254/343 X |
| 1,490,066 | 4/1924 | Carr | 294/74 X |
| 2,541,449 | 2/1951 | Vickers | 294/74 X |
| 2,678,191 | 5/1954 | Jensen | 254/343 X |
| 2,882,013 | 4/1959 | Margetts et al. | 254/343 |
| 3,467,359 | 9/1969 | Durand | 254/343 X |
| 3,934,919 | 1/1976 | Smith | 294/74 |
| 4,066,287 | 1/1978 | Rowley | 294/74 |
| 4,113,146 | 9/1978 | Williamson | 383/67 X |
| 4,362,292 | 12/1982 | Rowan et al. | 254/334 X |
| 4,520,979 | 6/1985 | McInnis | 248/323 |
| 4,830,427 | 5/1989 | Fiocchi | 296/136 |
| 4,941,645 | 7/1990 | Hall | 254/338 X |
| 5,240,305 | 8/1993 | Trethewey | 296/136 |
| 5,263,687 | 11/1993 | Garbiso | 254/334 |
| 5,320,394 | 6/1994 | Urbank | 294/74 |
| 5,498,047 | 3/1996 | Treuling | 294/74 |

*Primary Examiner*—Donald P. Walsh
*Assistant Examiner*—Emmanuel M. Marcelo
*Attorney, Agent, or Firm*—Boniard I. Brown

[57] ABSTRACT

A hardtop storage apparatus for storing a removable automobile hardtop has an overhead hoist including a depending lifting member attached to a sling including sling members which extend around and under opposite extremities of the hardtop and across the underside of the hardtop and are releasably joined at the underside of the hardtop in such a way that the sling members support the hardtop with a cradling action and without any direct attachment of the sling members to the hardtop when the hoist is operated to lift the sling and hardtop to an elevated storage position. Certain of the sling members are spaced by a stabilizing member to maintain the cradled hardtop in a balanced position. One disclosed embodiment of the hardtop storage apparatus has a fabric cover which encloses the stored hardtop and mounts a sleeve containing the stabilizing bar of the hardtop sling.

33 Claims, 3 Drawing Sheets

OVERHEAD HOIST AND SLING APPARATUS FOR REMOVING, STORING AND REPLACING A REMOVABLE AUTOMOBILE HARDTOP

BACKGROUND OF THE INVENTION

1. Field of the Invention

This invention relates generally to automobile accessories and more particularly to a storage apparatus for lifting a removable hardtop from an automobile, storing the hardtop in an elevated storage position, and replacing the hardtop on the automobile.

2. Discussion of the Prior Art

There is commercially available a hardtop storage apparatus including a hoist for lifting a removable automobile hardtop from the automobile body to facilitate storage of the hardtop on a special wheeled cart when the top is not being used and for later replacing the hardtop on its automobile body. This commercially available hoist comprises a winch mechanism including an overhead winch having a cable attached to a cross bar which can be lowered to a position over the roof of the hardtop. Depending from the ends of this cross bar are two griping devices for attachment to opposite edges of the hardtop. This hoist is selectively operable to lift the hardtop from and lower the hardtop onto the automobile body. The cart attaches to the cross bar to support the hard top for movement to and from a storage area.

This commercially available hardtop storage apparatus has several disadvantages. Among the foremost of these disadvantages are the following. The hardtop is not covered when stored on the wheeled cart and is therefor subject to the accumulation of dust and other airborne particles, vapor, and the like. Accordingly, use of the storage apparatus necessitates the frequent use of cleaners to clean the hardtop which involves the risk of scratching or otherwise marring the top. The hardtop is stored at ground level. As a consequence, a special area must be set aside for storing not only the hardtop when the top is positioned on the storage cart but also the cart by itself when the hard top is mounted on the automobile. Also, storage of the hardtop at ground level creates the ever present risk of damage to hardtop by a person carrying an object and running into the top or dropping the object on the top. Finally, the available storage apparatus is relatively costly since it requires two separate components, namely, the hoist and the storage cart, and transferring the hardtop from the hoist to the storage cart and from the cart to the hoist requires substantial manual skill and physical strength.

U.S. Pat. No. 4,600,177, dated Jul. 15, 1986, to Fritz and my prior U.S. Pat. No. 5,263,687, dated Nov. 23, 1993, disclose automobile hardtop storage apparatus which avoid at least some of these disadvantages of the commercially available hoist-cart storage system referred to above. These patented hardtop storage apparatus have the common features of a hardtop supporting harness and a hoist for lifting and lowering the harness. The harness includes straps joined to one another at a central support point of the harness and having free ends mounting clips in the form of hooks or plates for releasable attachment to opposite edges of a removable automobile hardtop. The hoist includes an overhead support to be mounted on the ceiling of a garage or the like and a flexible lifting member in the form of a cable or strap attached at one end to the support point of the harness and extending upwardly from the harness, over a roller on the overhead support, to a rotary drum which is rotatable in one direction to lift the harness to an elevated storage position and in the opposite direction to lower the harness to a lowered position. When the harness is in its elevated storage position, an automobile may be driven to and from a parked hardtop transfer position below the harness without contacting the harness or a hardtop supported by the harness. When in its lowered position, the harness is disposed for attachment to and detachment from the removable hardtop of an automobile in the parked hardtop transfer position.

These hardtop storage apparatus are used in the following way. An automobile mounting a removable hardtop is parked in the hardtop transfer position below the elevated harness, after which the hardtop is released for removal from the automobile, the harness is lowered, the harness clips are attached to opposite edges of the hardtop, and the harness is raised to lift the hardtop to an elevated storage position in which the automobile may be driven from and later return to the hardtop transfer position without contacting the elevated hardtop. The hardtop is replaced on the automobile by reversing this procedure.

In addition to the above features which are common to the hardtop storage apparatus of both patents mentioned above, the storage apparatus of my prior U.S. Pat. No. 5,263,687 includes a zippered hardtop dust cover and a pair of pivoted storage supports. The dust cover is attached to the harness and encloses the hardtop when in its elevated storage position. The storage supports are pivotally mounted on the overhead hoist support for movement between retracted positions in which they permit a hardtop to be lifted to and lowered from its elevated storage position and extended positions in which the storage supports are disposed to support a hardtop in its elevated storage position.

SUMMARY OF THE INVENTION

This invention provides an improved automobile hardtop storage apparatus. In contrast to the harness and hardtop attachment clip arrangement of the patented hardtop storage apparatus mentioned above, the improved hardtop storage apparatus of this invention has a sling which supports an automobile hardtop with a cradling action without the use of hooks, plates, or other clips attached to the hardtop edges. This sling has a generally central support point attached to a flexible lifting member of a hoist for lifting and lowering the sling. The sling comprises flexible sling members, preferably straps, having ends joined to one another at or close to the sling support point and opposite free ends, and connecting means for releasably joining these free ends of the sling members to one another. The hoist includes an overhead support to be mounted on an overhead structure, such as the ceiling of a garage, and means connecting the support and sling for lifting the sling to an elevated storage position and lowering the sling to a lowered position.

In use, the overhead support of the improved hardtop storage apparatus is secured to the ceiling of a garage or other suitable overhead structure of sufficient height above the underlying floor or other supporting surface to enable an automobile having a removable hardtop to park below the sling of the apparatus when sling occupies it elevated storage position. The hardtop of the parked automobile is released for separation from the automobile body, and spacers, depicted herein as gap pillows, are inserted between the top and the automobile body to provide spaces or gaps between the hardtop and the automobile body.

The hoist is now operated to lower the sling to a lowered position in which the support point of the sling is located just above or rests on the roof of the hardtop approximately in line with the center of gravity of the hardtop. Finally, the free ends of the flexible sling members are extended around and under opposite extremities, preferably the front and rear extremities or ends, of the hardtop and inserted through the gaps between these extremities and the underlying portions of the automobile The free strap ends are now pulled toward one another across the underside of the hardtop and joined to one another to form a completed cradle-like sling for the top. The hoist is then operated to lift the sling and the cradled hardtop to an elevated storage position with the top resting on the joined free end portions of the sling members which extend across the underside of the hardtop. In this elevated storage position, the automobile may be driven from under the hardtop and later returned to its parked position below the elevated hardtop for replacement of the top on the automobile without contacting the elevated top or sling.

The presently preferred hardtop storage apparatus of the invention described herein have a sling comprising a single front strap and two rear straps. The front strap extends forwardly from the sling support point around and under the front end of the cradled hardtop. The two rear straps extend rearwardly from the sling support point around and under the rear end of the hardtop. The free end of the front strap and the free ends of the two rear straps are releasably joined at the under side of the cradled hardtop. The pair of rear sling straps pass through slots in a stabilizing bar which retains these rear straps in proper spaced relation and aids in maintaining the hardtop in a balanced position. These preferred storage apparatus include hinged storage supports like those of my prior U.S. Pat. No. 5,263,687 which support the hardtop in its elevated storage position so as to remove the weight of the hardtop from the hoist. One described embodiment of the invention includes a dust cover which is secured to the sling and encloses the hardtop in its elevated storage position to shield the top against airborne dust and other particles and against damage by contact with an external object. This cover includes a sleeve which receives the stabilizing bar of the hardtop sling.

DESCRIPTION OF THE PREFERRED EMBODIMENTS

Figure 1:
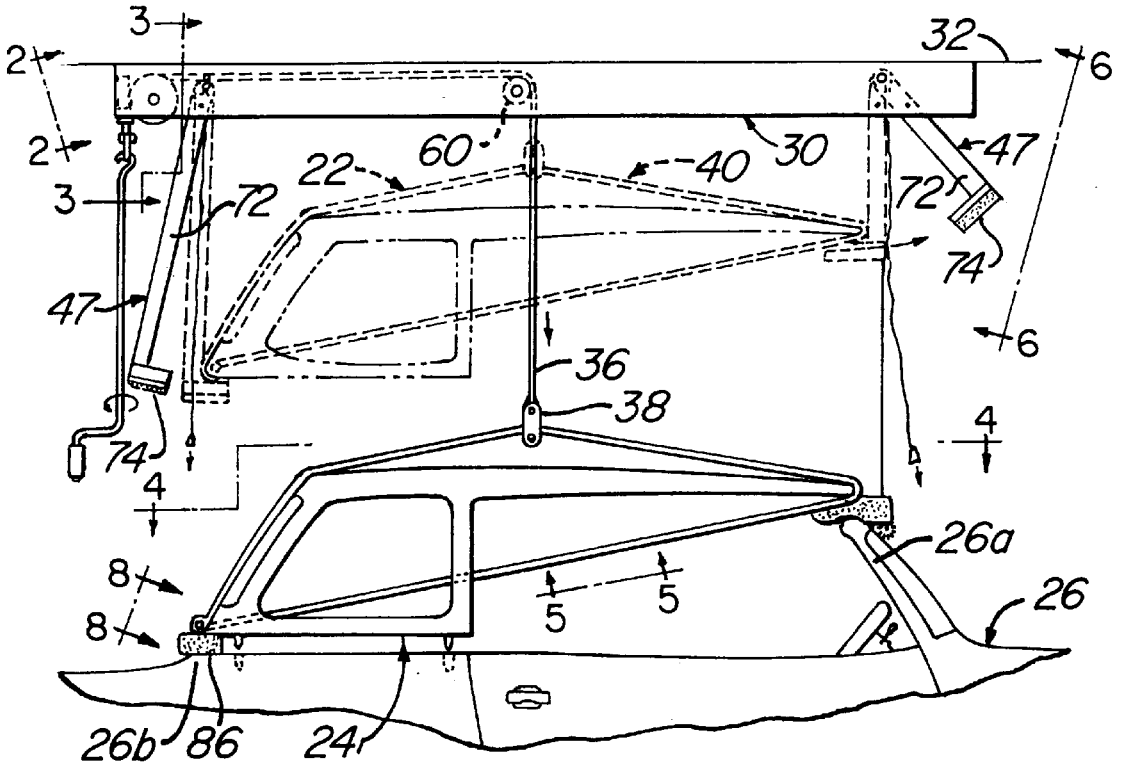
FIG. 1 is a side elevation of a presently preferred automobile hardtop storage apparatus according to this invention showing, in solid lines, the hardtop supporting sling of the apparatus in lowered cradling position about the removable hardtop of an automobile parked below the apparatus and showing, in broken lines, the sling and hardtop raised to their elevated storage position.
Figure 2:
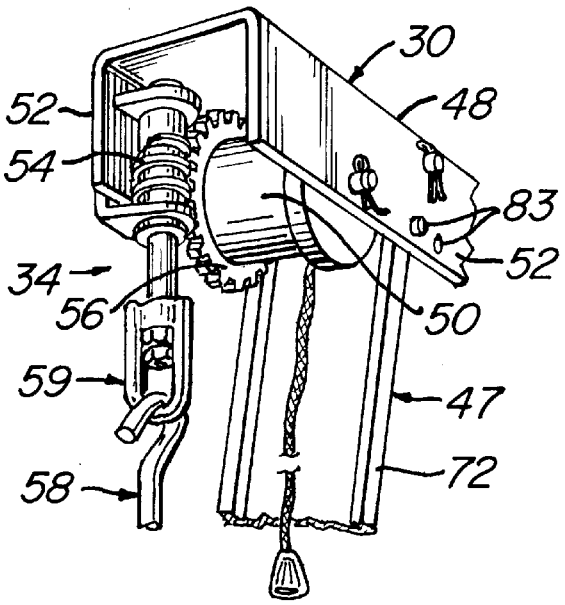
FIG. 2 is an enlarged perspective view, looking in the general direction of the arrows on line 2—2 in FIG. 1, of a winch mechanism embodied in the storage apparatus of FIG. 1.
Figure 3:
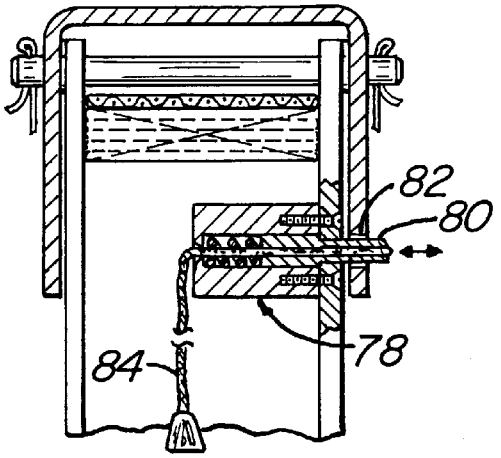
FIG. 3 is an enlarged section taken on line 3—3 in FIG. 1.

Turning now to these drawings and first to FIGS. 1–8, the illustrated automobile hardtop storage apparatus 20 includes a sling 22 for supporting in cradling fashion the removable hardtop 24 of an automobile 26 and a hoist 28 for lifting and lowering the sling and cradled hardtop between an elevated storage position illustrated in broken lines in FIG. 1 and a lowered position illustrated in full lines in FIG. 1. The hardtop shown is illustrative of commercially available hardtops offered by Mercedes Benz, General Motors (Corvette and Buick) and Chrysler. A typical hardtop weighs about 150 pounds and has opposite front and rear extremities or ends, opposite longitudinal extremities or sides, side walls with side windows along rear portions of the sides, and a rear wall with a rear window at the rear end of the hardtop. When the hardtop 24 is secured in place on the automobile 26, the front extremity or end of the hardtop is supported on and secured to the top of the automobile windshield frame 26*a*. The rear extremity or end of the hardtop is supported on and secured to a rear portion 26*b* of the automobile body. The longitudinal extremities or sides of the hardtop are supported on and secured to side portions of the automobile body.

Hoist 28 comprises a support 30 to be mounted on an overhead supporting structure 32 and a winch mechanism 34 on the support including a lifting member 36 attached to the sling 22 at a generally central sling support point 38 for raising and lowering the sling to and from its broken line elevated position of FIG. 1. Sling 22 comprises flexible sling members 40 having normally upper ends 42 which are permanently joined to one another at or close to the sling support point 38 and opposite normally lower free ends 44 and connecting means 46 for releasably joining these free ends.

As described in greater detail later, the hardtop storage apparatus 20 is mounted on an overhead support structure 32 of sufficient height above the underlying floor to enable an automobile 26 with a removable hardtop 24 to be parked below the storage apparatus without contacting the sling 22 when the sling is elevated with the sling straps gathered and secured about the lifting member 36. The sling 22 is engaged with the hardtop 24 of the parked automobile 26 by releasing the hardtop for separation from the automobile body, lowering the sling onto the top, extending the free ends 44 of the sling members 40 about opposite extremities of the hardtop and toward one another across the underside of the hardtop, and then joining the free ends of the sling members to one another by the connecting means 46 at the underside of the hardtop, as shown in full lines in FIG. 1. The winch 34 is then operated to lift the sling and hardtop to their broken line elevated storage positions of FIG. 1 in which the automobile 26 may be driven away and returned without contacting the elevated sling or hardtop. The sling 22 cradles the supported hardtop with the top resting on the joined lower free ends 44 of the sling members 40 extending across the underside of the top. Pivotally mounted on the support 30 are storage supports 47 which support the hardtop in its elevated storage position so as to remove the weight of the hardtop from the winch mechanism 34. The hardtop is replaced on the automobile by reversing this procedure.

Referring now in more detail to the illustrated hardtop storage apparatus, the hoist support 30 comprises a channel-shaped beam 48 firmly secured to the overhead support structure 32. This overhead support structure is normally the ceiling of a garage. The winch mechanism 34 comprises a rotary drum 50 situated between and rotatably mounted on the depending flanges 52 of the beam 48 for rotation on an axis normal to these flanges. Rigid on one end of the drum 50 is a worm wheel 56 which meshes with a vertical worm gear 56 rotatably mounted on one beam flange 52. Worm gear 54 is rotatable by a crank 58 to rotate the drum 50 in either direction. This crank is releasably connected by a releasable coupling 59 to the lower end of the worm gear for removal when not in use. The lifting member 36 of the winch mechanism 34 is a strap having an upper end fixed to the drum 50. This lifting strap extends over a roller 60 rotatably mounted between the beam flanges 52 and then downwardly to the sling 22. The lower end of the lifting strap is firmly fixed to the sling 22 at its support point 38.

Figure 4:
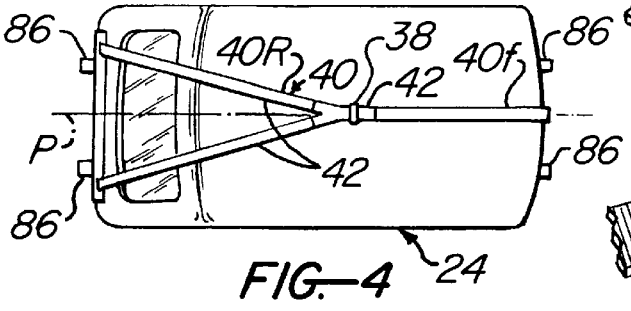
FIG. 4 is a view looking in the direction of the arrows on line 4—4 in FIG. 1.

The flexible members 40 of the sling 22 are straps including two straps **40*r* referred to herein as rear straps and a third strap 40*f* referred to as a front strap. The upper ends 42 of these sling straps are firmly joined to one another at or near the sling support point 38 with these joined upper strap ends disposed substantially in a common plane. As shown in FIG. 4, the two rear sling straps 40*r* extend in one direction from the sling support point 38 in diverging relation to one another and to a plane P which bisects the included angle between the rear straps and which plane is normal to the plane of and contains the longitudinal centerline of the winch lifting strap 36. The rear sling straps 40*r* extend through slots 61*a* in the ends of a stabilizing bar 61 whose function will be explained presently. The single front strap 40*f* extends in the opposite direction from the sling support point 38** with the longitudinal centerline of the front strap disposed substantially in the plane P.

Figure 5:
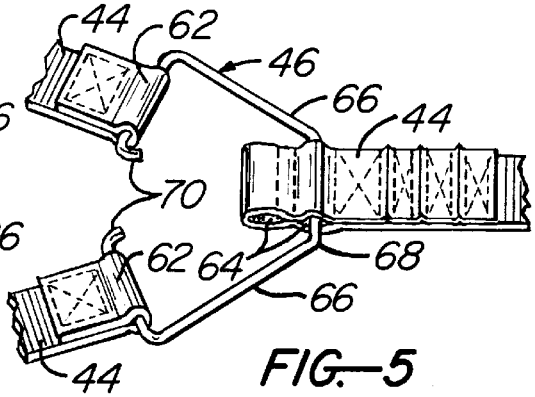
FIG. 5 is an enlarged view looking in the direction of the arrows on line 5—5 in FIG. 1.
Figure 6:
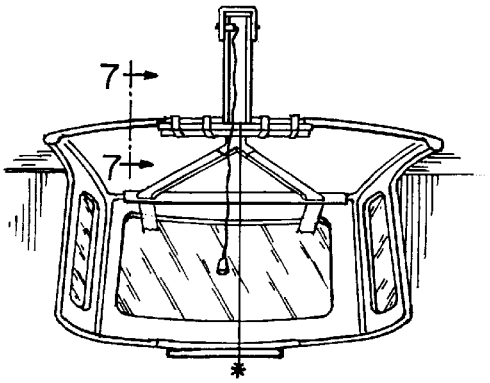
FIG. 6 is a view looking in the direction of the arrows on line 6—6 in FIG. 1.

Referring to FIG. 5, the lower free end 44 of each rear sling strap **40*r* has a single loop 62. The lower free end 44 of the front sling strap 40*f* has a plurality of loops 64 spaced along the strap. The strap connecting means 46 comprises a generally V-shaped tie hook including diverging arms 66 joined at one end by a flat apex portion 68 and inturned hook portions 70 at the other ends of the arms. The free ends 44 of the front and rear sling straps 40*f*, 40*r* are releasably joined by inserting the tie hook 46 through one loop 64 of the front strap to the position of FIG. 5 wherein the flat apex portion 68 of the hook is situated within the front strap loop and then inserting the hook-shaped free ends 70 of the tie hook arms 66 through the loops 62 of the rear straps, as shown. It is evident that the tie hook and loops comprise mating connecting elements which form a readily separable and engagable connecting means (46) and are readily engagable to positively join the free ends of the sling straps and readily separable to permit separation of these free ends. Accordingly, the connecting means 46** is adapted to be selectively engaged to positively secure the sling straps about the hardtop and separated to release the sling straps from the hardtop.

The pivoted hardtop storage supports 47 are similar to those described in my earlier mentioned U.S. Pat. No. 5,263,687. Each support includes a storage arm 72 pivoted at one end between the flanges 52 of the overhead support beam 30 on a horizontal axis normal to the longitudinal axis of the beam and a transverse storage base 74 on the lower end of the arm mounting cushions 76. The storage supports are rotatable between extended positions shown in solid lines in FIG. 1 and retracted positions shown in broken lines in FIG. 1. Mounted on the storage support arm 72 of each storage support 47 is a latch device 78 (FIG. 3) for releasably securing the support in its extended and retracted positions. Latch device 78 includes a latch pin 80 which is biased to the right in FIG. 3 by a spring 82 for selective engagement in a pair of latch holes 83 in one flange 52 of the support beam 30 to latch the storage support in its extended and retracted positions. Attached to the latch pin is a lanyard 84 which can be pulled to retract the latch pin and release the storage support from movement from one position to the other.

The manner in which the hardtop storage apparatus 20 is used to store the hardtop 24 of the automobile 26 will now be explained. When not in use supporting an automobile hardtop, the hardtop sling 22 is raised by the hoist 28 to an elevated position, and the sling straps 40 are gathered and secured about the lifting strap 36 in any convenient way such that the straps are prevented from contacting the automobile 26 when parked below the apparatus. The removable hardtop 24 of the automobile is stored by first latching the storage supports 47 in their broken line retracted positions of FIG. 1 and locating the automobile 26 below the storage apparatus in a hardtop transfer position in which the center of gravity of its hardtop 24 is vertically aligned as close as possible with the roller 60 over which the winch lifting strap 36 extends. The hardtop is released for separation from the automobile body and is then raised a small distance by hand to permit insertion of spacers 86, preferably cushioned spacers such as so-called gap cushions, between the front and rear ends of the hardtop and the underlying portions of the automobile body, that is between the front end of the hardtop and the top of the windshield frame **26*a* and between the rear end of the hardtop and the underlying rear portion 26*b* of the automobile body, as shown in FIG. 1. These spacers provide spaces or gaps between the ends of the hardtop and the underlying portions 26*a*, 26*b* of the automobile body through which the sling straps 40** are insertable, as described below. The spacers also prevent damaging contact of the hard top with the body as the top is lifted from the body.

Figure 7:
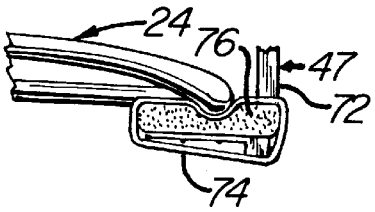
FIG. 7 is an enlarged view looking in the direction of the arrows on line 7—7 in FIG. 6.
Figure 8:
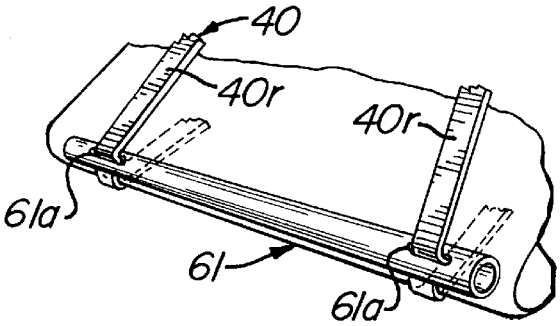
FIG. 8 is a perspective view looking in the general direction of the arrows on line 8—8 in FIG. 1.
Figure 9:
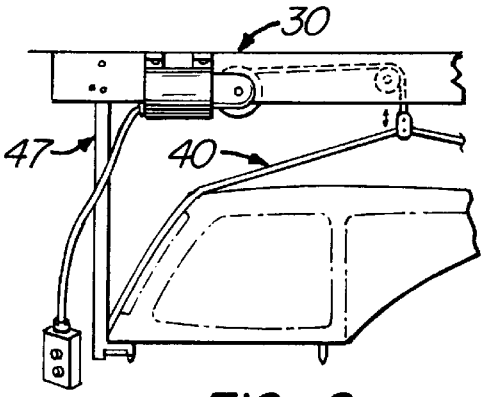
FIG. 9 illustrates a modified winch mechanism for the hardtop storage apparatus.

The crank 58 of the winch mechanism 34 is now turned in a direction to lower the sling 22 onto the roof of the underlying hardtop. The free end 44 of the front sling strap **40*f* is then passed around and under the front end of the hardtop and to the underside of the hardtop through the gap between the front end and the upper edge of the underlying windshield frame 26*a*. The free ends 44 of the rear sling straps 40*r* are passed through the slots 61*a* in the stabilizing bar 61 which is positioned just above the rear end of the hardtop, as shown in FIG. 1, and then around and under the rear end of the hardtop and to the underside of the hardtop through the gap between the rear end and the underlying rear portion 26*b* of the automobile body. Finally, the free ends of the three straps are drawn toward one another across the underside of the hard top and joined at the underside of the hardtop by the tie hook 46, after which the hoist crank 58 is turned in a direction to lift the sling 22 and the hardtop 24 to their broken line elevated storage positions of FIG. 1. The storage supports 47 are then returned to and latched in their solid line extended positions of FIG. 1 wherein their bases 74 underlay the ends of the hardtop. The sling is then lowered slightly to rest the ends of the hardtop on the cushions 76 of the storage supports, as shown in FIG. 7 and thereby remove the weight of the hardtop from the sling and hoist. The hardtop is replaced on the automobile by reversing the above procedure. If desired, the manual winch mechanism 34 may be replaced by the motor driven winch mechanism 34***a* in FIG. 9 which is identical to the winch mechanism in my U.S. Pat. No. 5,263,687.

If the automobile 26 is not parked with the center of gravity of its hardtop 24 precisely aligned with the roller 60, the winch mechanism 34 will tend to pull the hardtop horizontally as well as vertically during the initial portion of the lifting operation. The spacers 86 prevent damaging contact of the hardtop with the automobile body in the event that the hardtop is pulled horizontally in this way. A unique feature of the invention resides in the fact that the sling 22 supports the elevated hardtop 24 with a cradling action. That is to say, the sling cradles the hardtop with the lower edges of the hardtop resting on and supported by the joined end portions of the sling straps 40 which extend across the underside of the hardtop. The sling 22 is adjustable to accommodate hardtops of different sizes by engagement of the tie hook 46 in different ones of the loops 64 in the front sling strap 40*f*. In this regard, it is evident that the sling 22 has an effective circumferential dimension measured along the sling straps 40*f*, 40*r* from the joined upper strap ends 42, through the strap connecting means or tie hook 46, back to the upper strap ends. This circumferential dimension is adjustable by selective engagement of the tie hook in the loops 64 of the front sling strap 40*f*. The stabilizing bar 61 retains the two rear sling straps 40*r* in spaced diverging relation at the rear of the hardtop 24 in order to assure proper balancing of the hardtop 24 by the sling 22.

Figure 10:
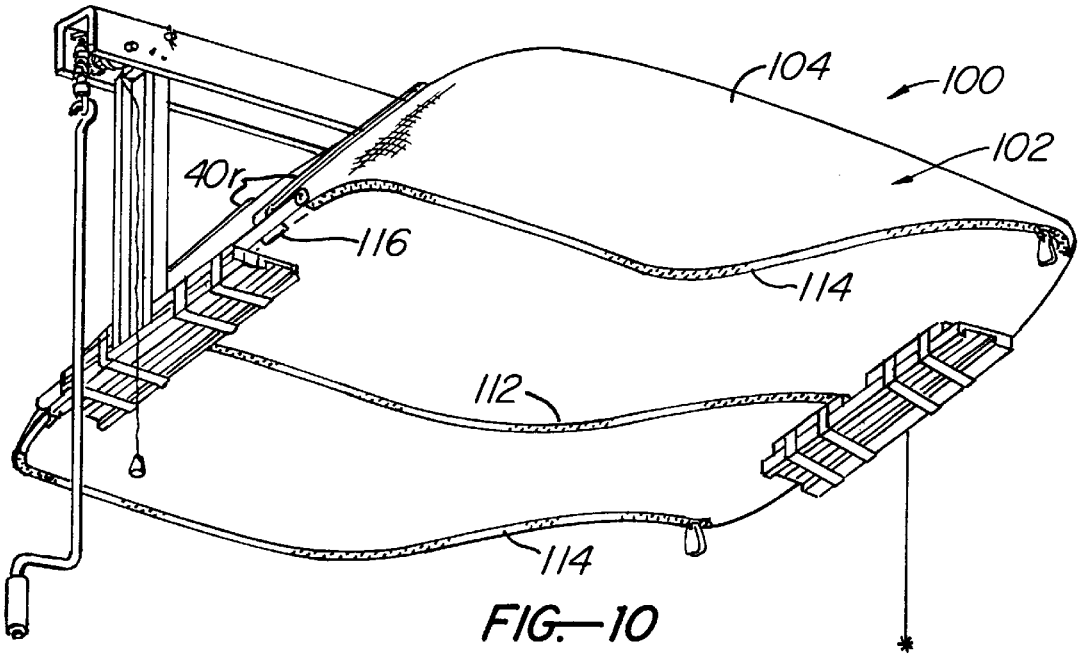
FIG. 10 is an enlarged perspective view of a modified hardtop storage apparatus according to this invention embodying a hardtop dust cover and showing the dust cover enclosing the hardtop with the cover and hardtop in their elevated storage position.
Figure 11:
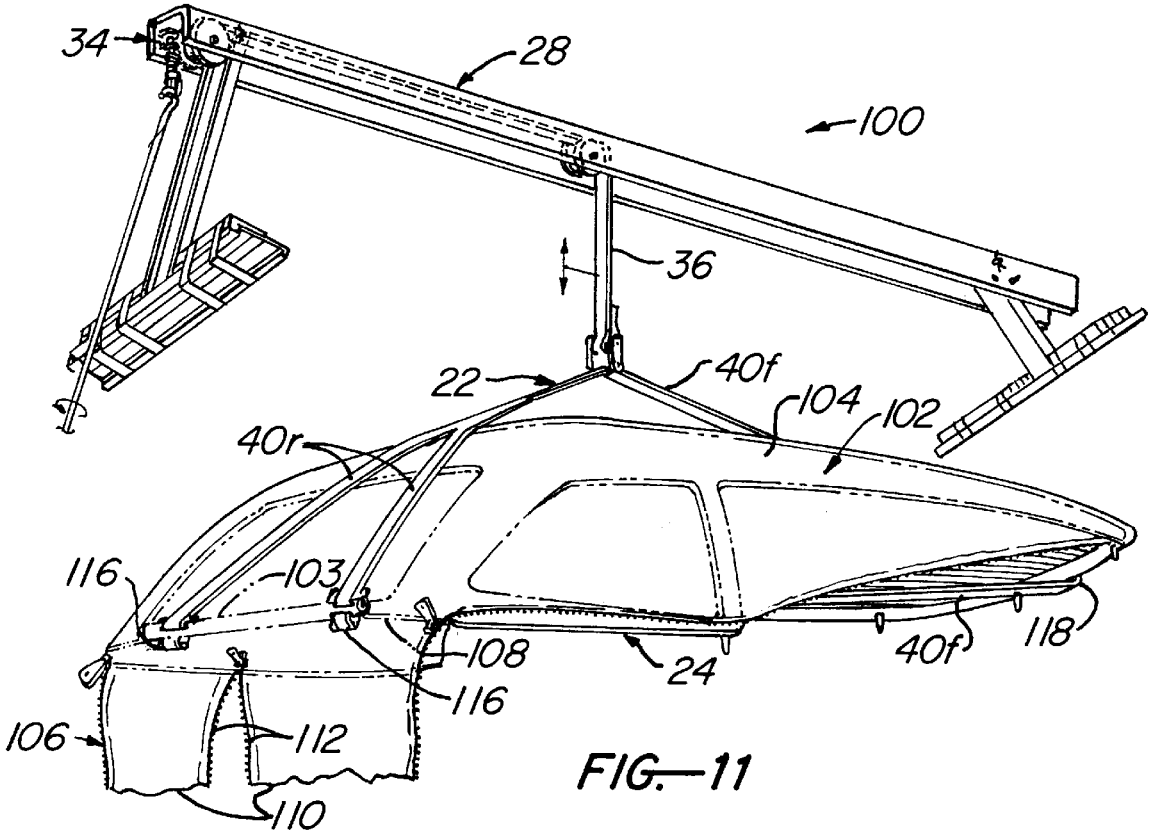
FIG. 11 is a view similar to FIG. 10 showing the sling of the hardtop storage apparatus supporting the hardtop and dust cover in lowered positions with the cover open in readiness for either closing the cover about the hardtop or replacing the hardtop on the automobile.

The modified hardtop storage apparatus 100 of FIGS. 10 and 11 comprises a hardtop sling 22 and a hoist 28 which are identical to those of FIGS. 1–9 and a dust cover 102 which is identical to that of my U.S. Pat. No. 5,263,687 except that the dust cover. 102 includes an open ended sleeve 103 for receiving the stabilizing bar 61 of the sling 22. Accordingly, it is unnecessary to re-describe the sling 22, hoist 28, and dust cover 102 in elaborate detail. Suffice it so say that the dust cover 102 has a top portion 104 which is shaped to fit over the hardtop 24 in the manner illustrated in FIG. 11 and a rear flap 106 joined to the top portion along a rear lower edge 108 of the top portion. This flap is divided along the longitudinal centerline of the top portion into two flap portions 110 and has a zipper 112 for joining the flap portions to one another along their adjacent longitudinal edges in the manner shown in FIG. 10. The cover top portion 104 and flap portions 110 have zippers 114 for joining the top and flap portions along their side edges with the dust cover enclosing the hardtop 24, as shown in FIG. 10. The stabilizing bar sleeve 103 is secured to the outer surface of the cover top portion 104 just above and parallel to the rear lower edge 108 of the top portion 104. The sleeve is centered along the edge 108 and has a length slightly less than the distance between the stabilizing bar slots 61*a*.

The stabilizing bar 61 of the sling 22 is positioned within the cover sleeve 103 of the sling with the slotted ends of the bar extending beyond the ends of the sleeve, as shown. Extending through the top portion 104 of the dust cover 102 along or close to its rear lower edge 108 are a pair of slots rear 116 which are aligned with the slots 61*a* in the stabilizing bar 61 when the bar is positioned in the sleeve. Midway along the front edge of the cover top portion 104 is a front slot 118.

The support point 38 of the sling 22 is located above the top portion 104 of the dust cover 102. The two rear sling straps 40*r* extend rearwardly from the sling support point 38 over the top portion of the cover, then downwardly across the rear side of the top portion, then through the slots 61*a* in the stabilizing bar 61, and finally through the rear cover slots 116 to the underside of the cover. The single front sling strap 40*f* extends forwardly from the sling support point 38 over the top portion of the cover and through the front cover slot 118 to the underside of the cover.

The modified hardtop storage apparatus 100 of FIGS. 10 and 11 is used in much the same way as the storage apparatus 20 of FIGS. 1–9. Thus, when the storage apparatus 100 is not being used to support the automobile hardtop 24, the sling 22 and dust cover 102 are raised to an elevated position and the dust cover and sling straps are gathered and secured in any convenient way about the winch lifting strap 36 so as to not contact the automobile 26 when parked below the storage apparatus. Storage of the automobile hardtop 24 is accomplished by separating the hardtop from the automobile by means of the spacers 86, operating the winch mechanism 34 of the storage apparatus to lower the sling 22 and dust cover 102 onto the roof of the hardtop, unzipping the cover zippers 112, 114, if necessary, and spreading the dust cover over the hardtop, and then extending the free ends of the sling straps 40*r*, 40*f* across the underside of the hardtop and joining these strap ends in the same manner as explained earlier in connection with FIGS. 1–9. The dust cover is then zippered closed about the hardtop and the hoist 28 is operated to lift the covered hardtop to the elevated storage position of FIG. 10. The hardtop is replaced on the automobile by reversing this procedure.

It is evident at this point that this invention provides the following removable automobile hardtop handing procedure: providing an overhead hoist including a lifting member hanging downwardly from the hoist, and a sling attached to the lower end of the lifting member and adapted for releasable supporting engagement with the automobile hardtop, whereby the sling is adapted to be lowered by the hoist to a lower position wherein the sling is engagable with and releasable from the automobile hardtop and raised by the hoist to a raised position wherein the sling is disposed to support the hardtop in an overhead storage position, parking the automobile below the sling when the sling is in its raised position, and performing the following additional steps (A) to remove the hardtop from the automobile and store the hardtop when the hardtop is initially mounted on the body of the parked automobile and the following additional steps (B) to replace the hardtop on the automobile when the hardtop of the parked automobile is initially supported in said overhead storage position by the sling:

(A) manually lifting the automobile hardtop a small distance above the automobile body to an initial elevated position in which the hardtop portions are spaced from the body portions, placing supports between the hardtop and body to support the hardtop in this initial elevated position, engaging the sling with the hardtop, and operating the hoist to raise the hardtop from its initial elevated position to the overhead storage position, (B) operating the hoist to lower the hardtop from the overhead storage position to an initial hardtop replacement position over the automobile body in which the hardtop portions are spaced from the body portions, placing supports between the hardtop and body to support the hardtop in this initial hardtop replacement position, releasing the sling from the hardtop, removing the supports, and manually lowering the hardtop onto the automobile body.

I claim:

1. Automobile hardtop storage apparatus for use with an automobile including a body and a removable hardtop on said body having opposite extremities, comprising:

a hoist to be mounted in an overhead position, a sling to be disposed in cradling relation about said hardtop with the sling extending across the underside of the hardtop from one of said hardtop extremities to the opposite hardtop extremity, and wherein said sling comprises three flexible sling members each having a first end connected to the hoist and an opposite free end, and readily separable and engageable connecting means releasably joining the free ends of said sling members and comprising mating connecting elements which are readily engageable to positively join said free ends, said sling members being adapted to extend about and under hardtop extremities, a pair of said sling members being adapted to extend about and under one of the hardtop extremities, and a third sling member is adapted for extension under the opposite hardtop extremity, whereby the free ends are adapted and positioned to be selectively joined to secure the sling members about the hardtop and separated to release the sling members from the hardtop, and said hoist when mounted in said overhead position is selectively operable to (a) raise said sling to a raised position wherein said automobile may be parked in a hardtop transfer position below the sling and (b) lower said sling to a lowered position wherein said sling members are adapted to be secured about and released from the automobile hardtop, whereby said hoist is adapted to lift the hardtop from said automobile body to an elevated hardtop storage position and lower the hardtop from said elevated hardtop storage position onto the automobile body.

2. A hardtop storage apparatus according to claim 1 wherein:

said hoist comprises a flexible lifting member having a lower end and which lifting member is raised and lowered by selective operation of the hoist, said first ends of said sling members are secured to the lower end of said lifting member, said sling members include a single sling member for extension around and under one of said hardtop extremities and a pair of sling members for extension around and under the opposite extremity of said hardtop, said first pair of sling members extend in diverging relation to one side of said lifting member, and said single sling member extends to the side of said lifting member opposite said one side of the lifting member and substantially in a plane bisecting the included angle between said pair of sling members.

3. A hardtop storage apparatus according to claim 2 including:

a stabilizing bar having spaced slots through which said pair of sling members extend at certain positions between the first and free ends of said pair of sling members for spacing said pair of sling members at said certain positions.

4. Apparatus according to claim 2, and further including:

spacers adapted for positioning between certain portions of said hardtop and certain portions of an automobile body to support the hardtop in elevated position to prevent damage to the automobile body during movement of the hardtop to position it relative to the automobile body.

5. A hardtop storage apparatus according to claim 1 including:

a stabilizing bar extending between and spacing said pair of sling members at positions between the first and free ends of said pair of sling members.

6. A hardtop storage apparatus according to claim 1 wherein:

said sling has a circumferential dimension measured in one direction along said sling members between said first ends of the sling members through said connecting means, and means for adjusting said circumferential dimension.

7. A hardtop storage apparatus according to claim 6 including:

a stabilizing bar extending between and spacing said pair of sling members at positions between the first and free ends of said pair of sling members.

8. A hardtop storage apparatus according to claim 6 including:

a stabilizing bar having spaced slots through which said pair of sling members extend at certain positions between the first and free ends of said pair of sling members for spacing said pair of rear sling members at said certain positions.

9. A hardtop storage apparatus according to claim 1 wherein:

said hoist comprises a rotary drum, a flexible lifting member wound on said drum and having a first end fixed to the drum and an opposite end secured to said sling, a worm wheel coaxially fixed to said drum, a rotatable worm gear meshing with said worm wheel, a hand crank, and universal connection joining said crank and worm gear.

10. A hardtop storage apparatus according to claim 1 including:

a hoist support mounting said hoist, hardtop support members mounted on said hoist support for movement between retracted positions wherein said support members are disposed to accommodate movement of the hardtop to and from said overhead storage position and extended positions wherein said support members are disposed to support the hardtop in said overhead storage position, and a spring loaded latch mounted on said hardtop support members and selectively engagable in holes in said hoist support for releasably locking said support members in said extended and retracted positions.

11. Apparatus according to claim 1, and further including:

said connecting means comprising loops at the free ends of said sling members and a tie hook releaseably engageable in said loops.

12. Apparatus according to claim 1, and further including:

spacers adapted to be positioned between certain portions of a hardtop and certain portions of the automobile body to support the hardtop in an elevated position to prevent damage by contact between the hardtop components and the automobile during lowering, lifting or shifting position of the hardtop into registration with the automobile body.

13. Apparatus according to claim 1, and further including:

spacers for positioning between certain portions of said hardtop and certain portions of said automobile to support the hardtop in an elevated position for adjustment of the position of the hardtop relative to the automobile.

14. Automobile hardtop storage apparatus for use with an automobile including a body and a removable hardtop on said body having opposite extremities, comprising:

a hoist to be mounted in an overhead position, a sling including flexible straps having first ends connected to said hoist, opposite free ends, and connecting means releasably joining said free ends, and said sling adapted to be disposed in cradling relation about said hardtop with said sling straps extending across the underside of the hardtop from one of said hardtop extremities to the opposite hardtop extremity, and wherein said hoist when mounted in said overhead position is operable to lift said sling to a raised position wherein said automobile may be situated in a hardtop transfer position below the sling and lower said sling to a lowered position wherein said sling is adapted to be engaged in said cradling relation about and released from the automobile hardtop, whereby said hoist is adapted to be selectively operated to lift the hardtop from said automobile body to an elevated hardtop storage position and lower the hardtop from said elevated hardtop storage position onto the automobile body, and said interconnecting means comprises loops at the free ends of said straps, and a tie hook releasably engagable in said loops.

15. A hardtop storage apparatus according to claim 14 wherein:

said sling has a circumferential dimension measured in one direction along said straps between said first ends of the straps through said tie hook, and one strap has a plurality of said loops spaced along said one strap through which said tie hook is selectively engagable for adjusting said circumferential dimension.

16. Apparatus according to claim 14, and further including:

spacers adapted for positioning between certain hardtop portions and certain automobile body portions to support the hardtop in an elevated position during positioning of the hardtop for accurate engagement with the automobile body.

17. Automobile hardtop storage apparatus for use with an automobile including a body and a removable hardtop on said body having opposite extremities, comprising:

a hoist to be mounted in an overhead position, a sling including a support point connected to said hoist means, flexible sling straps having first ends joined to one another adjacent said support point and opposite free ends, and connecting means releasably joining said free ends, and wherein said sling is adapted to be disposed in cradling relation about said hardtop with said sling straps extending across the underside of the hardtop from one extremity of said hardtop to the opposite hardtop extremity, said hoist when mounted in said overhead position is operable to lift said sling to a raised position wherein said automobile may be situated in a hardtop transfer position below the sling and lower said sling to a lowered position wherein said sling may be engaged in said cradling relation about and released from the automobile hardtop, whereby said hoist means is adapted to be selectively operated to lift the hardtop from said automobile body to an elevated hardtop storage position and lower the hardtop from said elevated hardtop storage position onto the automobile body, said sling straps include a first sling strap for extension around and under one extremity of said hardtop and a pair of sling straps for extension around and under the opposite extremity of said hardtop, said pair of sling straps extend in diverging relation from said sling support point, said first sling strap extends from said sling support point substantially in a plane bisecting the included angle between said pair of sling straps, said connecting means comprises loops at the free ends of said sling straps, and a tie hook releasably engagable in said loops, said sling has a circumferential dimension measured in one direction along said sling straps from said first ends of said sling straps, through said tie hook, back to said first ends of said sling straps, and said first sling strap has a plurality of said loops spaced along said first sling strap through which said tie hook is selectively engagable for adjusting said circumferential dimension.

18. Apparatus according to claim 17, and further including:

spacers adapted for positioning between certain hardtop portions and certain automobile portions to support the hardtop in an elevated position during accurate registration of the hardtop with the automobile to prevent damage.

19. Automobile hardtop storage apparatus for use with an automobile including a body and a removable hardtop on said body having opposite extremities, comprising:

a hoist to be mounted in an overhead position, a sling including a support point connected to said hoist means, flexible sling straps having first ends connected to one another at said support point, opposite free ends, and connecting means releasably joining said free ends, and wherein said sling is adapted to be disposed in cradling relation about said hardtop with said straps extending across the underside of the hardtop from one hardtop extremity to the opposite hardtop extremity, said hoist when mounted in said overhead position is operable to lift said sling to a raised position wherein said automobile may be situated in a hardtop transfer position below the sling and lower said sling to a lowered position wherein said sling may be engaged in said cradling relation about and released from the automobile hardtop, whereby said hoist means is adapted to be selectively operated to lift the hardtop from said automobile body to an elevated hardtop storage position and lower the hardtop from said elevated hardtop storage position onto the automobile body, said sling straps include a first sling strap for extension around and under one extremity of said hardtop and a pair of sling straps for extension around and under the opposite extremity of said hardtop, said pair of sling straps extend in diverging relation from said sling support point, said first sling strap extends from said sling support point substantially in a plane bisecting the included angle between said pair of sling straps, said sling includes a stabilizing bar having spaced slots through which said pair of straps extend for spacing said pair of straps between said first and free ends of said pair of straps, said connecting means comprises loops at the free ends of said straps, and a tie hook releasably engagable in said loops, said sling has a circumferential dimension measured in one direction along said sling straps from said first ends of said sling straps, through said tie hook back to said first ends of said sling straps, and said first sling strap has a plurality of said loops spaced along said first sling strap through which said tie hook is selectively engagable for adjusting said circumferential dimension.

20. Automobile hardtop storage apparatus for use with an automobile including a body and a removable hardtop on said body having an underside and opposite extremities, said storage apparatus comprising:

a fabric dust cover for covering the hardtop including a top portion having an underside, a sling secured to said dust cover extendable across the underside of said cover portion and across the underside of the hardtop from one of said hardtop extremities to the opposite hardtop extremity, a hoist connected to said sling and adapted to mounted in an overhead position for lifting said sling and cover to an elevated position wherein said automobile may be situated in a hardtop transfer position below the sling and cover and lowering said sling and cover to a lowered position wherein said cover is adapted to cover the automobile hardtop and said sling is adapted to be engaged in said cradling relation about and released from the automobile hardtop, whereby said hoist is adapted to be selectively operated to lift the cover and hardtop from said automobile body to an elevated hardtop storage position and lower the hardtop and cover from said elevated hardtop storage position onto the automobile body, and wherein said sling comprises flexible sling members having first ends connected to said hoist and opposite free ends extendable across the underside of said hardtop, and readily separable and engagable connecting means joining said ends for separation and reengagement of said free ends, said sling members include a pair of sling members for extension around and under one of said hardtop extremities, said sling includes a stabilizing bar spacing said pair of sling members between said first and free ends of said pair of sling members, and said cover includes a sleeve containing said stabilizing bar.

21. Automobile hardtop storage apparatus for use with an automobile including a body and a removable hardtop on the body having an underside and opposite extremities, said storage apparatus comprising:

a fabric dust cover for covering the hardtop including a top portion having an under side, a sling secured to said dust cover and having a support point, a hoist connected to said sling support point and adapted to be mounted in an overhead position for lifting said sling and cover to an elevated storage position wherein said automobile may be situated in a hardtop transfer position below the sling and cover and lowering said sling and cover to a lowered position wherein said cover is disposed for covering and uncovering the automobile hardtop and said sling is adapted to engaged in said cradling relation about and released from the automobile hardtop, whereby said hoist is adapted to be selectively operated to lift the cover and hardtop from said automobile body to an elevated hardtop storage position and lower the hardtop and cover from said elevated hardtop storage position onto the automobile body, and wherein said sling comprises a plurality of flexible sling members having first ends joined to one another adjacent said sling support point and opposite free ends for extension across the underside of said hardtop, and connecting means for releasably joining said free ends to one another, said sling members include a first sling member for extension around and under said extremity of said hardtop and a pair of sling members for extension around and under the opposite extremity of said hardtop, said pair of sling members extend in diverging relation from said sling support point, said first sling member extends from said sling support point substantially in a plane bisecting the included angle between said pair of sling members, said sling includes a stabilizing bar having slots through which said pair of sling members extend at certain positions between said first and free ends of said pair of sling members for spacing said pair of sling members at said certain position, and said cover includes a sleeve containing said stabilizing bar.

22. A hardtop storage apparatus according to claim 21 wherein:

said cover top portion has a lower edge and said cover includes a panel joined to said cover top portion along a portion of said lower edge and having a closed position wherein the panel extends across and closes the bottom of said top portion, said top portion and said panel include means for releasably securing said panel in its closed position, said sleeve is secured to said top portion just above and parallel to said lower portion, and said top portion has slots approximately along said lower edge portion through which said pair of straps extend from said stabilizing bar to the under side of said top portion.

23. A sling for an automobile hardtop storage apparatus for lifting and storing an automobile hardtop having an underside and opposite extremities, said sling comprising flexible sling members having first ends joined to one another and opposite free ends, an elongate flexible lifting member secured at one end to said joined first ends of said sling members for lifting and lowering said sling, connecting means releasably joining the free ends of said sling members to one another comprising mating connecting elements which are readily engageable to positively join said free ends and readily separable to permit separation of said free ends, whereby said free ends are adapted to be selectively joined to secure the sling members about the hardtop and separated to release the sling members from the hardtop, and wherein said sling members include sling members extending in opposite lateral directions from said lifting member, a pair of the sling members extending around and under one extremity of the hardtop, the sling members being adapted for joining of their free ends by said connecting means at the underside of the hardtop and said sling having an effective circumferential dimension measured in one direction along said sling members from said joined first ends of the sling members, through said connecting means, back to said joined first ends of the sling members, and said sling includes means for adjusting said circumferential dimension, and said sling including a stabilizing bar spacing said pair of sling members at a position between said ends of the sling members.

24. A sling apparatus according to claim 23, wherein:

said connecting means comprises loops at said free ends of the sling members, and a tie hook releasably engageable in said loops.

25. Apparatus according to claim 23, and further including:

spacers for positioning between the hardtop and the automobile to support the hardtop in an elevated position to prevent damage to the automobile when the hardtop is lowered, shifted or adjusted to position it relative to the automobile.

26. A sling and automobile hardtop storage apparatus for lifting and storing an automobile hardtop having an underside and opposite extremities, the storage apparatus including a hoist and a lifting member for attachment to the sling, said sling comprising:

flexible sling members having first ends joined to one another and opposite free ends, attachment means secured to said joined first ends of said sling members for attaching said sling members to said lifting member, connecting means releasably joining the free ends of said sling members to one another, and wherein said sling members include sling members extending in opposite directions from said attachment means for extension around and under the opposite extremities of the hardtop and joining of their free ends by said connecting means at the underside of the hardtop, said free ends of said sling members have loops, and said connecting means comprises a tie hook releasably engageable in said loops.

27. A sling and automobile hardtop storage apparatus for lifting and storing an automobile hardtop having an underside and opposite extremities, said storage apparatus including a hoist and a lifting member for attachment to the sling, said sling comprising:

flexible sling members having first ends joined to one another and opposite free ends, attachment means secured to said joined first ends of said sling members for attaching said sling members to said lifting member, connecting means releasably joining the free ends of said sling members to one another, and wherein said sling members include sling members extending in opposite directions from said attachment means for extension around and under the opposite extremities of the hardtop and joining of their free ends by said connecting means at the underside of the hardtop, said sling members include a pair of sling members extending in one direction from said attachment means for extension around and under one extremity of the hardtop, said sling includes a stabilizing bar spacing said pair of sling members at a position between said ends of the pair of sling members, and a fabric hardtop cover secured to said sling members and including a sleeve containing said stabilizing bar.

28. A sling according to claim 27, wherein:

said connecting means comprises a tie hook releaseably engageable in loops at the free ends of the sling members.

29. A hardtop handling method for an automobile including a body and a removable hardtop mounted on said body with portions of the hardtop engaging portions of the body, said method comprising the steps of:

providing an overhead hoist, a lifting member hanging downwardly from the hoist, and a sling adapted for releasable supporting engagement with the automobile hardtop including flexible sling members having first ends connected to said lifting member and opposite free ends and readily separable and engagable connecting means releasably connecting said free ends, whereby the sling is adapted to be lowered by the hoist to a lower position wherein the sling is engagable with and releasable from the automobile hardtop and lifted by the hoist to a raised position wherein the sling is disposed to support the hardtop in an overhead storage position, parking the automobile below said sling when the sling is in its raised position, and performing the following additional steps (A) to remove the hardtop from the automobile and store the hardtop when the hardtop is initially mounted on the body of the parked automobile and the following additional steps (B) to replace the hardtop on the automobile when the hardtop of the parked automobile is initially supported in said overhead storage position by said sling:

(A) lifting the automobile hardtop a small distance above said automobile body to an initial elevated position in which said hardtop portions are spaced from said automobile body portions, extending said free ends of said sling members to the underside of said hardtop through certain spaces between said hardtop portions and body portions, joining said free ends, and operating said hoist to raise the hardtop to said overhead storage position, (B) operating said hoist to lower the hardtop from said overhead storage position to a lowered position in which said hardtop portions are spaced from said body portions, separating said free ends of said sling members, withdrawing the free ends of the sling members through spaces between said hardtop portions and body portions, and lowering the hardtop onto the automobile body.

30. The method of claim 29 wherein;

said step of supporting said hardtop in said initial elevated position comprises placing spacers between certain of said hardtop portions and said body portions, and said step of supporting said hardtop in said lowered replacement position comprises placing spacers between certain of said hardtop portions and said body portions.

31. The method of claim 30 wherein:

said spacers comprise cushions.

32. A method according to claim 29, and further comprising the step of:

placing spacers between certain of said hardtop portions and certain of said body portions to support the hardtop to prevent damage to said automobile body and the hardtop by relative movement in adjusting the position of the hardtop relative to the automobile body.

33. In combination with an automobile hardtop storage apparatus including a sling adapted for cradling about a hardtop, and an automobile body with an open top:

a removable hardtop mounted on said automobile over the open top with portions of the hardtop engaging portions of the body, said hardtop being adapted to be manually lifted a small distance above said body with said hardtop portions spaced from said body portions, and spacers to be positioned between certain of said hardtop portions and said body portions to support said hardtop in said elevated position.

* * * * *